United States Patent [19]

Young

[11] 4,072,256

[45] Feb. 7, 1978

[54] GAME BALL HOLDER

[76] Inventor: Daniel L. Young, 3250 Plumas St. No. 116, Reno, Nev. 89509

[21] Appl. No.: 691,791

[22] Filed: June 1, 1976

[51] Int. Cl.[2] ..... A63B 49/00

[52] U.S. Cl. ..... 224/5 D; 206/315 B; 224/45 L; 273/73 R

[58] Field of Search ..... 224/5 R, 5 C, 5 D, 45 L, 224/25 R; 150/52 G; 206/315 B; 273/22, 29 R, 32 D, 73 R, 74; 24/3 R, 3 F; 211/14, 49 R; 248/309 R, 309 A

[56] References Cited

U.S. PATENT DOCUMENTS

| | | | |
|---|---|---|---|
| D. 238,628 | 2/1976 | Davis | 224/5 D X |
| 578,541 | 3/1897 | Bredow | 211/49 R X |
| 1,911,256 | 5/1933 | Andrew | 224/25 R X |
| 2,109,799 | 3/1938 | Moore | 224/5 D X |
| 2,548,330 | 4/1951 | Wiseman | 224/5 D |
| 3,047,140 | 7/1962 | Robins | 206/315 B |
| 3,873,009 | 3/1975 | Goudreau | 273/32 D X |
| 3,943,989 | 3/1976 | Sperling | 273/74 X |

FOREIGN PATENT DOCUMENTS

| | | | |
|---|---|---|---|
| 573,899 | 4/1959 | Canada | 224/5 D |
| 480,051 | 4/1953 | Italy | 273/73 R |
| 228,745 | 2/1925 | United Kingdom | 224/45 L |
| 593,934 | 10/1947 | United Kingdom | 211/14 |

*Primary Examiner*—Lawrence J. Oresky
*Assistant Examiner*—Winston H. Douglas
*Attorney, Agent, or Firm*—Townsend and Townsend

[57] ABSTRACT

A portable ball-holding device for carrying tennis balls or the like and which can be worn by the player at the small of the back in an unobtrusive manner. A substantially flat base member has a facing surface, a reverse surface and a plurality of projections extending from the facing surface and mutually spaced to define a plurality of ball receiving regions each dimension to removably receive one ball. Each projection is provided with an enlarged head portion at the distal end to facilitate retention of a ball.

Several alternate means for attaching the holding device to a carrying member include a central portion of the base member and a pair of flanking flexible tab members formed so that the tab members may be inserted into the waistband of a player's garment, with the rear surface of the base member and the front surface and the free end of each tab member textured to provide improved frictional engagement with the player's garment; and adhesion means secured to the reverse surface of the base member for releasable attachment to a complementary adhesion means secured to the player's garment; and a pair of slots formed in opposing edges of the base member through which a fabric or leather belt may be passed to secure the device around the player's waist.

A cover member fabricated from transparent plastic forms a protective package for the balls, which may also function as a pressurized original sale carton by providing a rupturable seal at the junction between the cover portion and the base member.

12 Claims, 10 Drawing Figures

GAME BALL HOLDER

BACKGROUND OF THE INVENTION

This invention relates to portable devices for releasably grasping a game ball, particularly a tennis ball.

Many games require a player to carry a plurality of game balls on his person in order to facilitate game play. For example, in the game of tennis or squash, each player typically carries three balls to promote play of the game. For many players it is at best awkward and at worse very difficult to carry three balls in one hand. If the player has a pocket, the two spare balls may be placed in this pocket; however, the rather large volume of each ball relative to the size of the typical pocket causes the garment to tighten about the player's body which restricts the player's freedom of movement. Insertion of the balls into the pocket of the garment also produces an unsightly bulge which is undesirable.

Several tennis ball holders have been designed for the purpose of carrying spare balls and which are adapted to be worn by the user. Such holders typically comprise a modified belt having pockets large enough to removably receive a ball or a tubular section in which a plurality of balls may be stored. Such types of ball holders are cumbersome and have also been found to interfere with the player's freedom of movement.

SUMMARY OF THE INVENTION

The invention comprises a portable ball-holding device especially adapted for carrying tennis balls or the like and which can be worn by the player at the small of the back in such a manner that the player's freedom of movement is completely unrestricted.

In the most general aspect, the invention comprises a substantially flat base member having a facing surface, a reverse surface and a plurality of projections extending from the facing service in a direction substantially normal thereto, with each projection terminating in a distal end. The projections are mutually spaced in order to define a plurality of ball-receiving regions each dimensioned to removably receive one ball. In the preferred embodiment, the projections are all arranged at points on a circle whose radius is substantially equal to the radius of the ball for which the device is designed, with a first group of projections arranged at the apices of a first triangle and a second group arranged at the apices of a second smaller triangle, both triangles being isosceles. To facilitate retention of a ball in the holder, each projection may be provided with an enlarged head portion at the distal end thereof. In order to facilitate insertion and removal of balls, each projection is slightly resilient and optionally has a slightly tapered outer wall surace.

The invention also includes several alternate means for attaching the holding device to a carrying member. In one embodiment, the attaching means includes a central portion of the base member and a pair of flanking flexible tab members formed along opposing portions of the base member in such a manner that the flexible tab members may be bent in the direction of the reverse surface and inserted into the waistband of a player's garment near the small of the back. The rear surface of the base member and the front surface of the free end of each flexible tab member may be textured to provide improved frictional engagement with the garment of the player. In an alternate embodiment, the reverse surface of the base member is provided with an adhesion means, such as Velcro or the like, for releasable attachment to a complementary adhesion means secured to the player's garment in the region of the small of the back.

Both of the above embodiments may also be adapted for use with the conventional tennis racket cover during transport of the equipment to and from the playing court.

In another alternate embodiment of the attaching means, a pair of slots are provided in opposing edges of the base member through which a fabric or leather belt may be passed to secure the device around the player's waist.

The invention may also be provided with a cover member fabricated from transparent plastic or the like to form a protective package for the balls. This package may also serve as a pressurized original sale carton by providing a rupturable seal at the junction between the cover portion and the base member.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
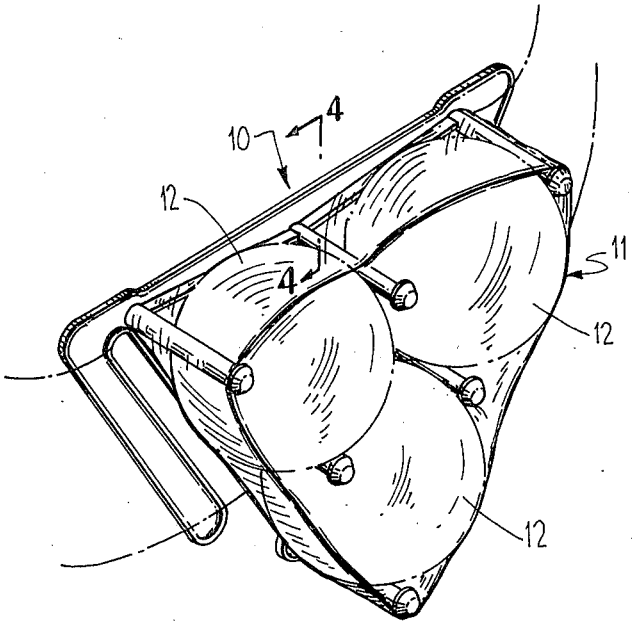
FIG. 1 is a perspective view showing a first embodiment of the invention with cover attached.

Turning now to the drawings, FIG. 1 shows a perspective view of a first embodiment of the invention. As shown in this Fig., the invention comprises an integrally formed ball-holding device generally designated by reference numeral 10 and an optional removable cover member generally designated by reference numeral 11, the latter element being preferably fabricated from a transparent plastic material in order to render balls 12 visible.

Figure 3:
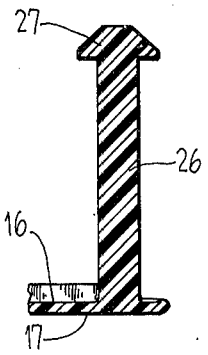
FIG. 3 is a sectional view taken along lines 3—3 of FIG. 2 illustrating one of the projections.
Figure 2:
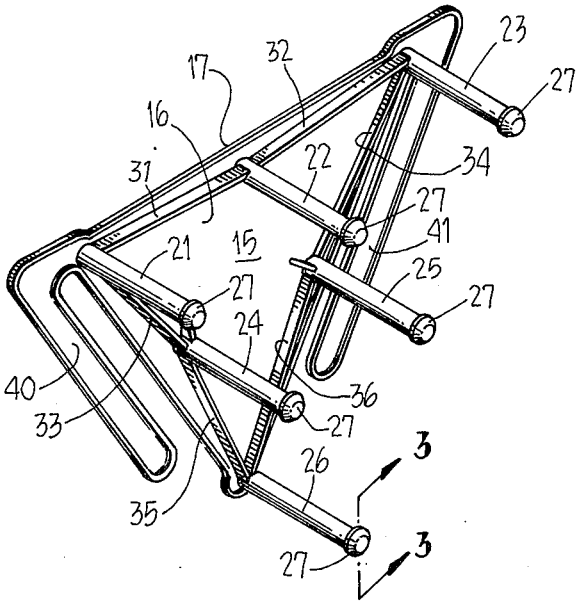
FIG. 2 is a perspective view similar to FIG. 1 showing the device with the cover and balls removed.

As best shown in FIGS. 2 and 3, device 10 includes a substantially flat thin flexible base member 15 having a generally triangular shape and a plurality of integrally formed projections 21–26 extending in a direction generally normal to the facing surface 16 of base member 15 and terminating in an enlarged head portion 27. Projections 21–26 are each joined by integrally formed stiffener ribs 31–36 for providing additional strength to device 10, which is preferably fabricated from plastic by conventional molding techniques.

As shown in FIG. 1, each ball 12 is releasably held by a group of three projections, with enlarged head portions 27 providing additional clenching action for the associated ball. To facilitate insertion and removal of the balls 12, the outer surface of each projection is tapered sightly along the longitudinal axis in a symmetric manner. In the preferred embodiment, this taper angle is approximately 1° with respect to the axis of each projection.

In the embodiment shown in FIGS. 1 and 2, base member 15 is provided with a pair of generally opposed flexible tab members 40, 41 for removably attaching the invention to the waistband of a player's garment. With reference to FIG. 2, to attach the device tab members 40, 41 are first bent in the reverse direction from surface 16 and inserted from the top of the player's waistband so that the facing surface of tab members 40, 41 is on the inside of the garment waistband and the reverse surface 17 of the central portion of base member 15 is on the outside of the garment. The garment may be a pair of shorts, a skirt or the like and the invention may be optimally arranged by attaching it in the region of the small of the back so that the player's movements are completely unhampered while wearing the device.

Figure 5:
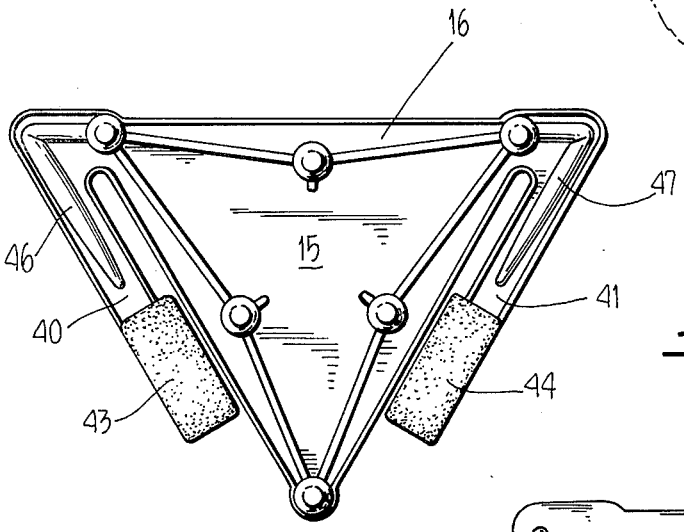
FIGS. 5 and 6 are front and rear plan views, respectively, of an alternate embodiment of the invention.
Figure 6:
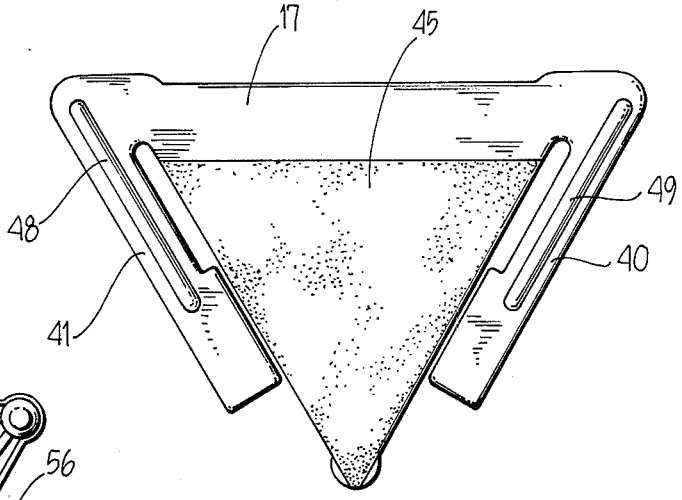

FIGS. 5 and 6 illustrate an alternate embodiment of the basic invention which provides additional frictional gripping action with the player's garment. As seen in these Figs., flexible tab members 40, 41 are provided with enlarged free end portions 43, 44 having a textured surface, while the reverse surface 17 of the device is provided with a central textured portion 45. In the preferred embodiment, these textured surfaces are fabricated by embodying the design in the corresponding structural portions of a proper mold and the entire unit is molded from a suitable plastic material in accordance with conventional techniques known to those skilled in the art.

The embodiment of FIGS. 5 and 6 is also provided with strengthening ribs 46–49 to impart additional rigidity to flexible tab members 40, 41.

It should be noted that the rectangular configuration of enlarged free end surfaces 43, 44 is illustrative only and that other geometrical shapes may be employed, as desired.

Figure 8:
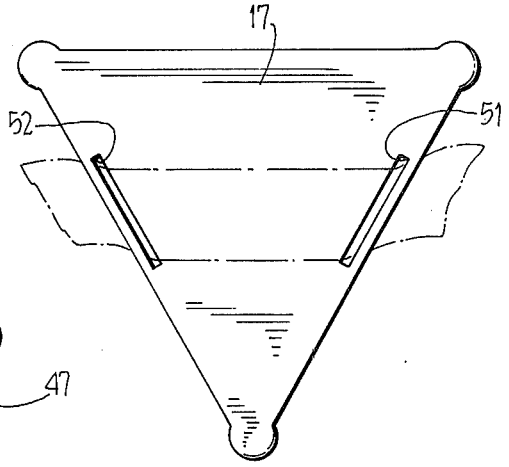
FIGS. 7 and 8 are front and rear plan views respectively, of another alternate embodiment of the invention.
Figure 7:
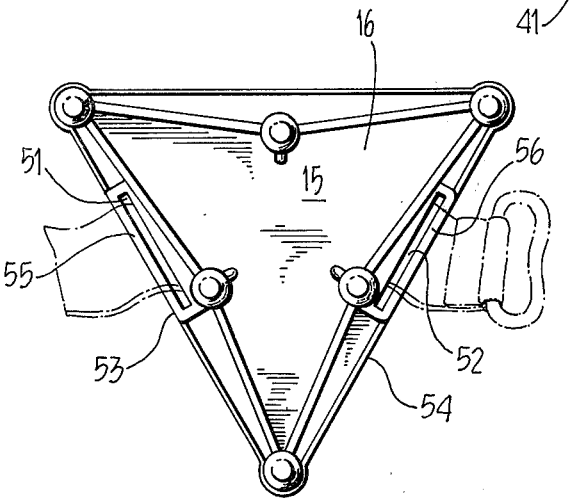

FIGS. 7 and 8 illustrate an alternate embodiment of the invention provided with a different means for attaching the ball holder to the player. As seen in these Figs., the flexible tabs 40, 41 have been eliminated and a pair of slots 51, 52 are formed in opposing edges 53, 54 of the base member 15. Stiffener ribs 55, 56 are formed about each of the slots 51, 52 to provide additional strength to the plastic base material. This embodiment is adapted to be worn about the waist of the player and slots 51, 52 are dimensioned to receive a fabric or leather belt shown in phantom.

Figure 9:
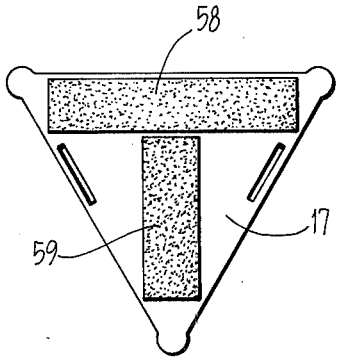
FIG. 9 is a plan view of the reverse side of an alternate embodiment of the invention.

FIG. 9 is a plan view of the reverse surface of an alternate embodiment of the invention having different means for attaching the device to the player's garment or other carrying member. As seen in this Fig., a first pair of adhesion strips 58, 59 are secured to reverse surface 17 of base member 15 of the embodiment of FIGS. 7 and 8. A complementary pair of adhesion strips (not shown) are secured to the user's garment or other carrying member so that strips 58, 59 may be releasably mated therewith. Strips 58, 59 and the complementary strips are preferably fabricated from Velcro or other suitable adhesion material. It should be noted that the first adhesion means comprising strips 58, 59 may take other geometrical shapes, and that a single piece of adhesion material may be employed, as desired. The facing portion of the alternate embodiment of FIG. 9 is substantially identical to that illustrated in FIG. 7.

Figure 10:
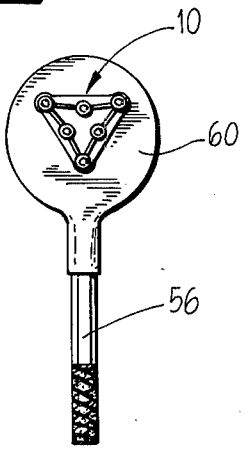
FIG. 10 is a plan view illustrating an alternate use of the invention.

FIG. 10 illustrates an alternate use of the invention for transporting balls to and from the playing court. As shown in this Fig., the embodiment of FIG. 9 may be attached to the cover 60 for the player's racket 56 by simply securing the complementary adhesion material to the outside of cover 60 in a convenient location and adhering the holder 10 thereto with strips 58, 59.

Figure 4:
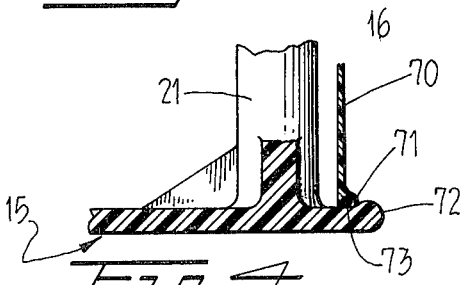
FIG. 4 is a sectional view taken along lines 4—4 of FIG. 1.

Cover member 11 provides a removable protective enclosure in concert with the ball-holding device 10. Optionally, cover member 11 may be designed so that elements 10, 11 comprise an original sealed package at the point of manufacture. Since many tennis balls are packed under a partial pressure, a protective seal must be provided to properly package the balls. FIG. 4 illustrates such a seal. As seen in this Fig., each wall, such as wall 70 of cover member 11, terminates in an end portion 71 which is sealed to facing surface 16 at the outer edge thereof. To facilitate this seal, base member 15 is slightly enlarged along the perimeter 72 thereof and the seal may be effected by a conventional heat-melt step after balls 12 have been secured in projections 21–26 and cover 11 installed. End portion 71 of wall 70 is further provided with a cord 73 embedded therein to facilitate rupturing of the seal and opening of the package. If desired, other equivalent sealing and rupturing arrangements known to those skilled in the art may be provided.

As will now be apparent, the invention provides a simple, lightweight, low-cost means for holding and carrying game balls which may be conveniently worn by the user while participating in the sport and which provides a dust-free storage compartment for the balls when not in use. Further, since the ball-holding device can be worn in the region of the small of the back, it does not interfere with the movements of the player at all. In addition, the invention also provides a useful original package for the balls and an attractive display device as well.

While the above provides a full and complete disclosure of the invention, various modifications, alternate constructions and equivalents may be employed without departing from the true spirit and scope of the invention. Therefore, the above description and illustrations should not be construed as limiting the scope of the invention, which is defined by the appended claims.

What is claimed is:

1. A portable device capable of holding a plurality of balls, said device comprising:

a unitary substantially flat base member having a facing surface, a reverse surface, a plurality of elongate projections extending from said facing surface in a direction substantially normal thereto and each terminating in a distal end having an enlarged portion for clenching a ball, said plurality of projections including a first sub-plurality of projections, each located at a different apex of a first isosceles triangle, and a second sub-plurality of projections located within the perimeter of said first isosceles triangle, each located at a different apex of a second isosceles triangle, each of said second sub-plurality of projections being substantially equi-distant from a pair of adjacent projections of said first sub-plurality, the linear distance between any two of said second sub-plurality of projections being less than the linear distance between the mid-points of each line joining a pair of said projections of said first sub-plurality, each of said projections of said first sub-plurality and the two of said projections of said second sub-plurality in closest proximity being arranged at points on one of a plurality of circles in a plane parallel to said facing surface, each one of said circles having a radius substantially equal to the radius of a ball, each of said projections of said second sub-plurality being arranged at a point on two of said circles, a plurality of pairs of reinforcement rib portions extending along said facing surface with each of said pairs associated to a different one of said projections of said first sub-plurality, each one of said rib portions of a given pair extending between the associated projection of said first sub-plurality and a different one of the two projections of said second sub-plurality in closest proximity to said associated projection, and means for attaching said device to a carrying member.

2. The combination of claim 1 wherein said attaching means includes a central portion of said reverse surface of said base member and first and second flexible tab members formed along opposing portions of said base member.

3. The combination of claim 2 wherein said tab members are provided with a textured facing surface.

4. The combination of claim 2 wherein said central portion of said reverse surface is textured.

5. The combination of claim 1 wherein said attaching means comprises adhesion means secured to said reverse surface and adapted to be releasably attached to a complementary adhesion means secured to said carrying member.

6. The combination of claim 5 wherein said adhesion means and said complementary adhesion means are fabricated from Velcro.

7. The combination of claim 1 wherein said attaching means includes a pair of slotted apertures provided in opposite edges of said base member adapted to receive a flexible belt member.

8. The combination of claim 1 further including a cover member releasably secured to said base member.

9. The combination of claim 8 wherein joined portions of said base member and said cover member are provided with a a rupturable sealing joint.

10. The combination of claim 1 wherein each of said elongate projections is substantially cylindrical.

11. The combination of claim 1 wherein each of said elongate projections has an outer surface which is tapered inwardly along said direction.

12. The combination of claim 11 wherein the taper angle is substantially 1°.

* * * * *